US008720115B2

(12) United States Patent
Schwelling

(10) Patent No.: US 8,720,115 B2
(45) Date of Patent: May 13, 2014

(54) DOOR FOR A PAPER SHREDDER

(76) Inventor: Hermann Schwelling, Salem (DE)

( * ) Notice: Subject to any disclaimer, the term of this patent is extended or adjusted under 35 U.S.C. 154(b) by 385 days.

(21) Appl. No.: 12/449,275

(22) PCT Filed: Jan. 29, 2008

(86) PCT No.: PCT/EP2008/000648

§ 371 (c)(1),
(2), (4) Date: Jul. 30, 2009

(87) PCT Pub. No.: WO2008/092621

PCT Pub. Date: Aug. 7, 2008

(65) Prior Publication Data

US 2010/0050532 A1 Mar. 4, 2010

(30) Foreign Application Priority Data

Jan. 30, 2007 (DE) ..... 10 2007 006 339

(51) Int. Cl.
*B02B 7/02* (2006.01)

(52) U.S. Cl.
USPC ..... 49/400; 49/501; 49/503; 49/381; 241/100; 241/285.3

(58) Field of Classification Search
USPC ..... 49/400–402, 501, 503, 381; 312/138.1, 312/326, 329; 52/784.1; 220/662, 810; 241/100, 285.3
See application file for complete search history.

(56) References Cited

U.S. PATENT DOCUMENTS

| | | | | |
|---|---|---|---|---|
| 5,375,781 | A * | 12/1994 | Schwelling | 241/100 |
| 5,894,706 | A * | 4/1999 | Herbst | 52/782.1 |
| 5,934,584 | A * | 8/1999 | Schwelling | 241/285.1 |
| 6,193,091 | B1 * | 2/2001 | Olivetti | 220/23.88 |
| 6,641,066 | B2 * | 11/2003 | Kamiya | 241/47 |
| 6,681,524 | B1 * | 1/2004 | Tillson | 49/169 |
| 6,962,301 | B1 * | 11/2005 | Chang | 241/100 |
| 2003/0182896 | A1 * | 10/2003 | Bienick et al. | 52/784.1 |
| 2004/0163323 | A1 * | 8/2004 | Herrmann et al. | 49/501 |
| 2007/0075170 | A1 * | 4/2007 | Kim | 241/100 |
| 2008/0283645 | A1 * | 11/2008 | Mussig et al. | 241/221 |

FOREIGN PATENT DOCUMENTS

| | | |
|---|---|---|
| DE | 9003149 | 6/1990 |
| DE | 4329950 | 3/1995 |
| DE | 19963248 | 9/2000 |
| EP | 0616851 | 9/1994 |
| EP | 0818861 | 1/1998 |

* cited by examiner

*Primary Examiner* — Katherine Mitchell
*Assistant Examiner* — Marcus Menezes
(74) *Attorney, Agent, or Firm* — Horst M. Kasper

(57) ABSTRACT

The invention relates to a door for a paper shredder, for closing at least one interior that is open to one side and location below a cutting mechanism in the housing of the paper shredder or a similar device, comprising at least one viewing window and hinges for fastening the door to the housing, the door being composed of at least two profiled parts.

Figure 1A:
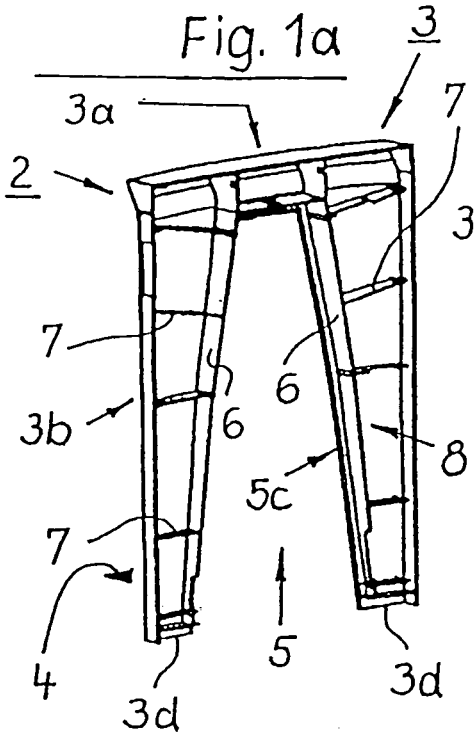

2 Claims, 9 Drawing Sheets detail B detail C section A - A

A
D
12
10
3a
3d
2
12a
11a
13
7
4

Fig. 8
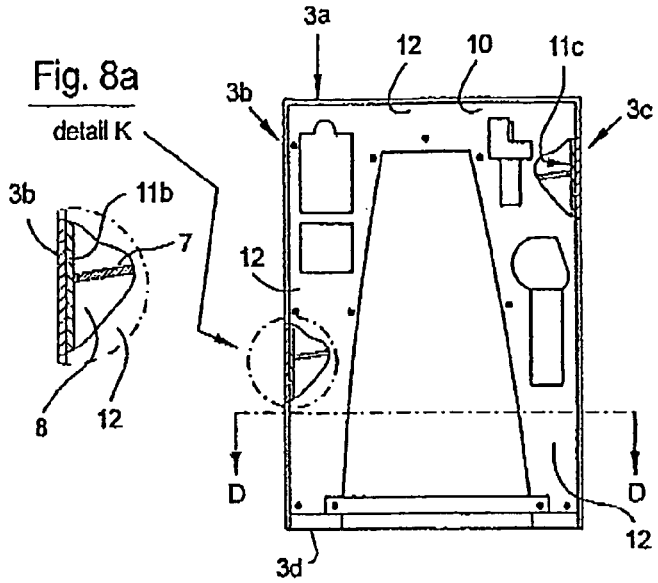
Fig. 8a
detail K
Fig. 7b
section D - D
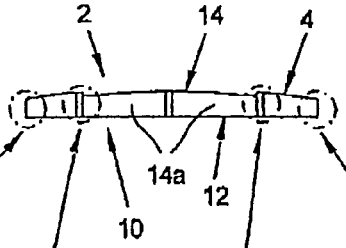
Fig.7e
detail E
Fig.7h
detail H
Fig. 7f
detail F
Fig. 7g
detail G
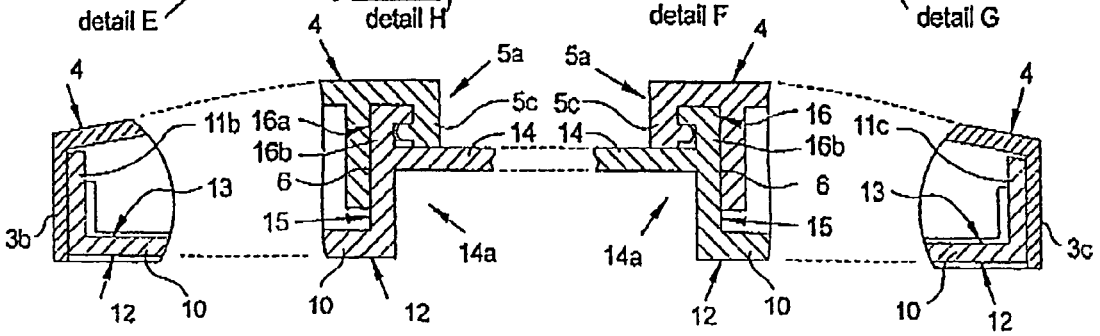

DOOR FOR A PAPER SHREDDER

The invention relates to a door for a paper shredder, for closing an inner space of the paper shredder, which inner space is furnished within a casing and below a cutting works of the paper shredder for receiving of a catch container for the comminuted material.

File shredders for the comminution of data carrier material shaped as sheet shaped documents, CDs, micro films, diskettes and like materials are known in the most different kinds and powers.

File shredders of the lower power class usually have a catch container, frequently also called a paper basket or collection basket, which container in applied state at the same time closes the receiver opening in the casing of the file shredder such that no gripping in up to the cutting works or up to parts of the cutting works can be performed. These catch containers cooperate with safety switches, which safety switches prevent a transfer into an operational state of the cutting works while the catch container is removed.

The two narrow front faces of the side walls of the casing of a file shredder and the front face of the catch container form the front face of the file shredder.

The casings are formed much more stable corresponding to the occurring forces as well as caused by the size of the cutting works with file shredders of the middle and upper power class as with file shredders of the lower power class. These casings usually are made out of wood.

The withdrawal opening for inserting and removal of the catch container is closed with a door. The catch container can be a catch basket or also a catch bag or catch sack attached to a frame. The door is opened for removal of the catch container or of a catch bag, which would enable a gripping into up to the cutting works. A safety switch would be actuated simultaneously during an opening of the door, wherein the safety switch prevents an operation of the file shredder.

These doors are usually also made out of wood, and predominantly out of pressed chips panels or a similar material.

A view window is provided in the doors for allowing to observe the work progress and also the filling state of the catch container during operation of the file shredder.

Also the mass of such doors is disadvantageous in addition to sensitivity to impact and jerks of such doors consisting of wood or wood compound materials and to the cost expenditure for adhesive and glue materials which do not damage the health. The mass is in particular disadvantageous for the handling during production and mounting.

Therefore it is an object of the invention to develop a door for a paper shredder, wherein the door is cost favorable with respect to both material costs and production costs as well as with regard to transportation costs and which exhibits a high degree of stability.

A file shredder in the sense of the present invention is an apparatus for comminution of data carrier material, which can be sheet formed documents, CDs, micro films, diskettes or the like materials.

This object is obtained according to the invention by a door for a paper shredder with the features of claim 1. The following claim 2 further describes the invention.

The door for a paper shredder according to the invention, for closing of at least one one-sided open inner chamber furnished below cutting works in the casing of the paper shredder or of a similar apparatus, has preferably a viewing window as well as hinges for attaching at the casing and is composed of two profile parts according to a new mode of construction, preferably out of an outer door sheet and an inner door sheet. The two parts of the door are force matching and/or form matching connected to each other.

Profile parts in the sense of the invention are parts, where one or several part faces, face sections or face strips of the main face starting from the plane of their main face are disposed under an angle to the same main face, wherein these regions fleeing from the main plane are angled single fold or multiple fold or are guided along an arc, and in fact in one spatial direction or successively following in several special directions, wherein the spatial directions can also be disposed opposite to each other.

These profile parts are preferably produced as injection molded parts and are preferably made out of plastic.

The inner chamber serves for receiving a catch container, where the comminuted material discharged by the cutting works is collected.

The advantage based on the correspondingly to each other disposed part regions of the two door sheets in the assembled state results that the body of the door becomes a very stable construction unit, in particular in the upper region, at the force engagement point during opening and closing of the door.

The connection of the two door parts is produced by screwing, adhesive attachment or welding. Preferred is the force matching connection point wise between the two parts of the door.

The advantage of a screw connection comprises that in addition to a form matching connection there can be accomplished still another connection can be accomplished, which is increasing the stiffness of the door, which is force matching and which is however disengageable.

The two door sheets are preferably produced out of plastic such that the door exhibits a lower weight.

According to a special new mode of construction, the outer door sheet has a profiled edge angled essentially by 90 degrees out of a front face of the outer door sheet, wherein this profiled edge is circulating at three sides of the door sheet, preferably at its left section, at its upper section and at its right section. A conical preferably door arch like or trapezoidal recess is provided preferably symmetrical to an imaginary vertical symmetry plane, disposed in the outer door sheet, and directed body inwardly from the lower section, wherein the recess preferably upwardly projects up to the upper region of the outer door sheet and wherein the recess grips through the front face and the oppositely disposed face.

This recess has sideways upwardly directed longitudinal arms, which end on top in an upper cross arm. The longitudinal arms of the conical, preferably door arch shaped recess, preferably exhibit a U-shaped profiled edge.

The inner door sheet has a profiled edge angled essentially by 90 degrees relative to an outer face of the inner door sheet, wherein this profiled edge circulates at three sides of the inner door sheet, preferably also in its left, upper, and right section.

A door inwardly directed depression is disposed in the inner door sheet starting from the outer face of the inner door sheet and corresponding to the conical, preferably door arch shaped recess in the outer door sheet and corresponding to the conical, preferably door arch shaped or trapezoidal recess in the outer door sheet. The front edges at the depression exhibit profiled webs, which are formed corresponding to the U-shaped profiled edges of the longitudinal arms, whereby a further stiffening and stabilization of the door is induced.

In addition, further recesses or, respectively, depressions are provided in the outer face of the inner door sheet, where preferably accessories for the paper shredder can be placed such as for example maintenance oil, catch bags, and the like.

At least one of the profile parts, preferably the inner door sheet, in particular the depression of the inner door sheet, consists out of an at least translucent and preferably transparent material, whereby an observer can always direct a view into the inner chamber of the paper shredder and onto the comminuted material.

Based on the preceding described novel formed door there result essential advantages for the logistics as well as relative to the costs for production (producing, assembly, surface treatment), storage and transport plus required transport volume, to the wholesaler, store or final recipient.

The invention is illustrated further and in more detail in the following by way of an embodiment example shown schematically in the drawings.

Figure 1B:
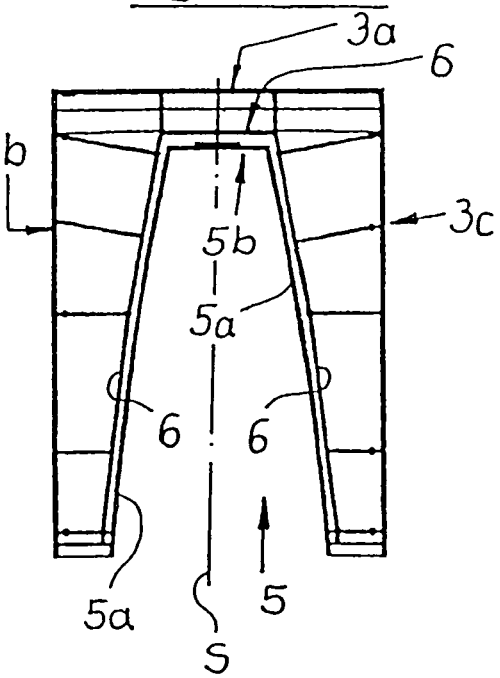
Figure 2A:
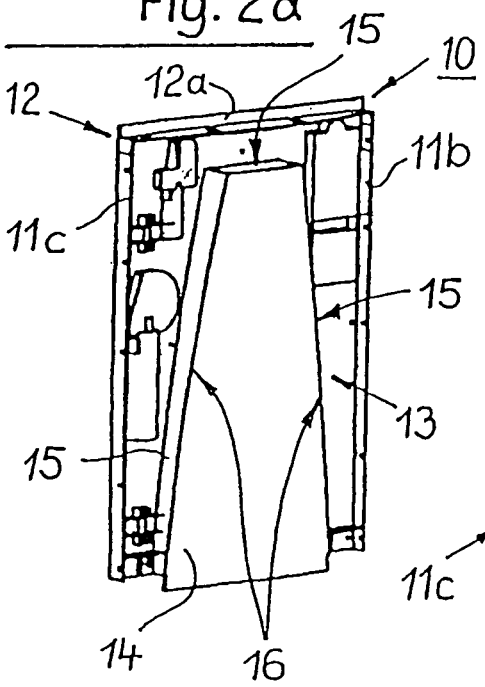
Figure 2B:
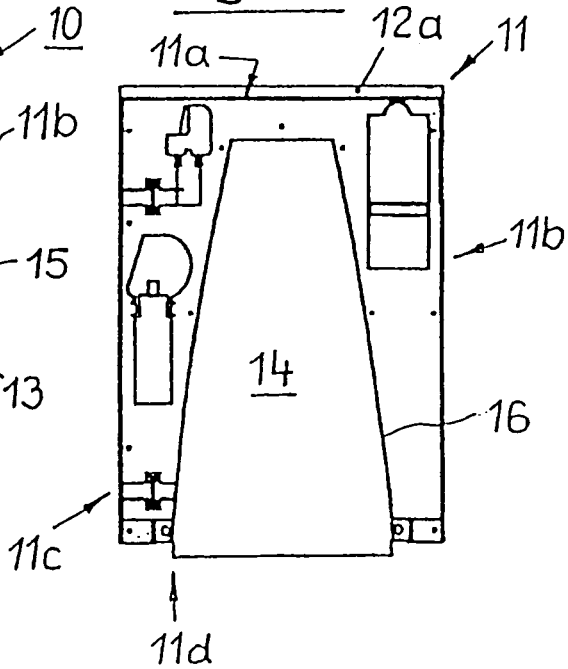
Figure 3:
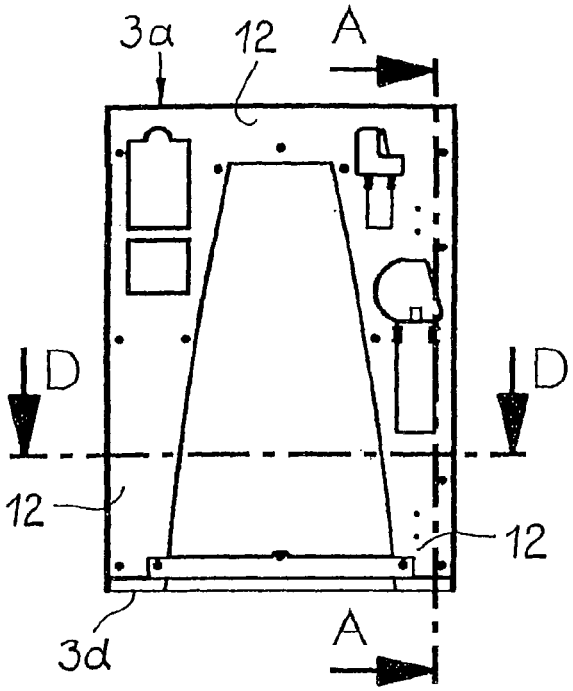
Figure 3A:
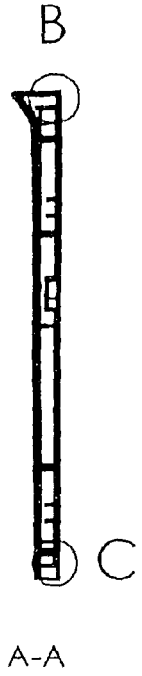
Figure 3B:
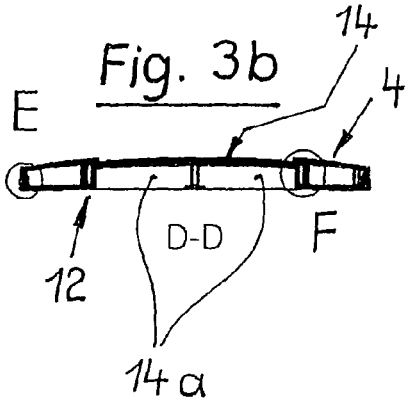
Figure 3G:
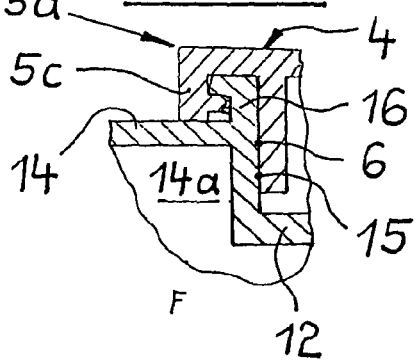
Figure 3C:
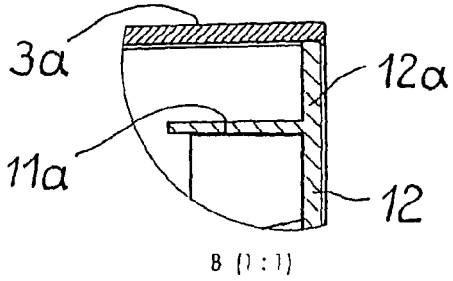
Figure 4:
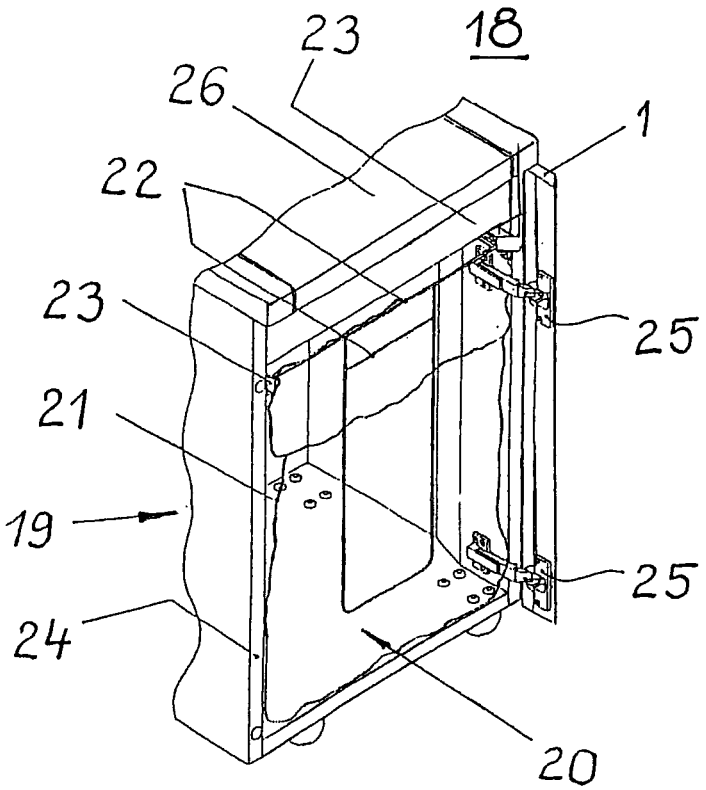
Figure 5:
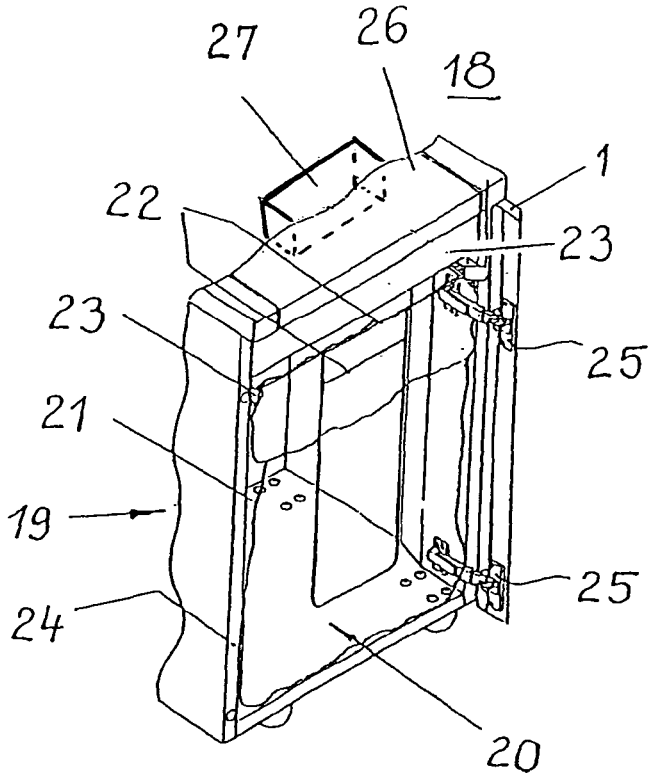
Figure 6:
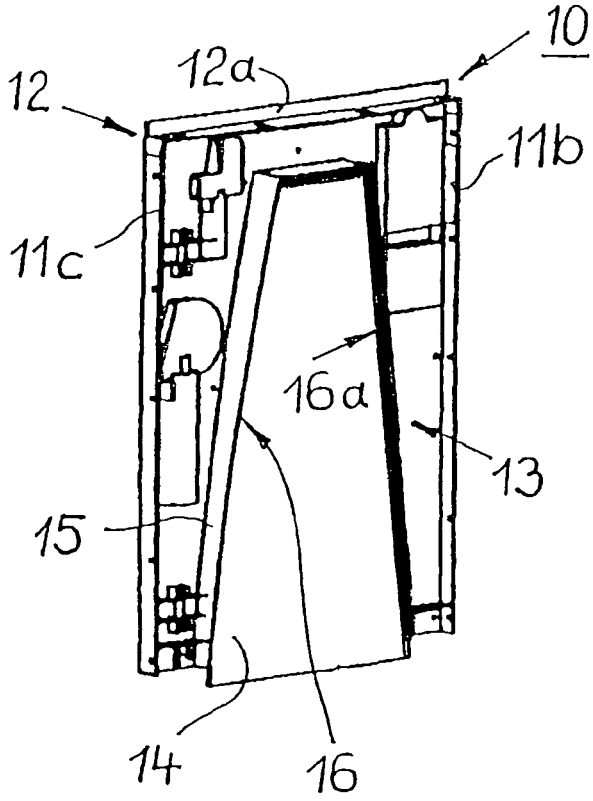

There is shown:

FIG. 1*a* and FIG. 1*b* an outer door sheet of the novel door of a file shredder according to the present invention;

FIG. 2*a* and FIG. 2*b* an inner door sheet of the new door;

FIG. 3*a* to FIG. 3*f* a novel door in an assembled state, in various views and with various details;

FIG. 3*g* a further detail relative to the form matching between the outer door sheet and the inner door sheet;

FIG. 4 a partial elevational view onto the body of a file shredder, where the novel door is attachable to the file shredder;

FIG. 5 a partial elevational view onto the body of a file shredder with cutting works;

FIG. 6. a view similar to the view of a FIG. 2*a;*

Figures 7, 7A, 7C, 7D:
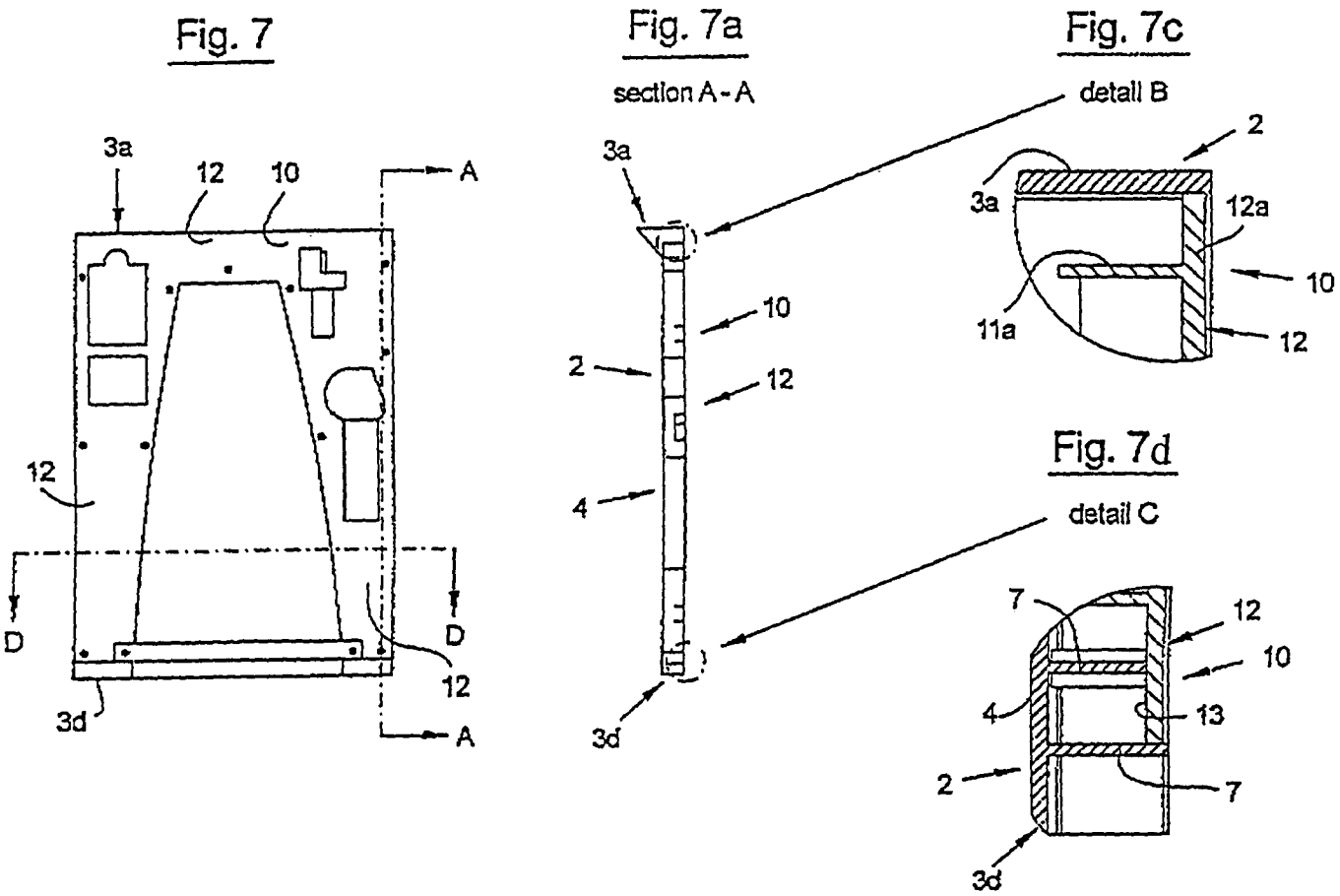

FIG. 7 a front elevational view onto an inner outer face of a door;

FIG. 7*a* a side elevational view of the door of FIG. 7;

FIG. 7*b* a top planar view of the door of FIG. 7;

FIG. 7*c* a top detail of FIG. 7*a;*

FIG. 7*d* a bottom detail of FIG. 7*a;*

FIG. 7*e* a left detail of FIG. 7*b;*

FIG. 7*f* a center-right detail of FIG. 7*b;*

FIG. 7*g* a right detail of FIG. 7*b;*

FIG. 7*h* a center-left detail of FIG. *b;*

Figure 9:
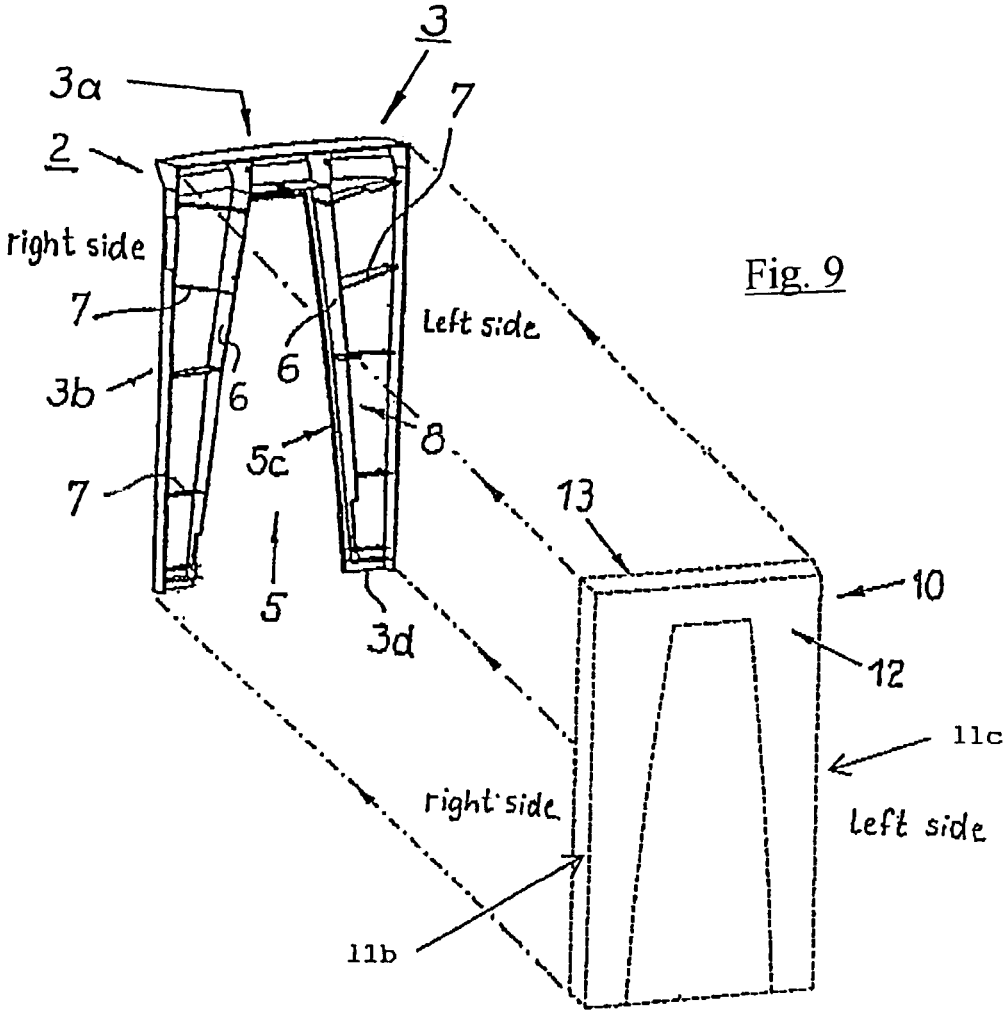
Figure 9A:
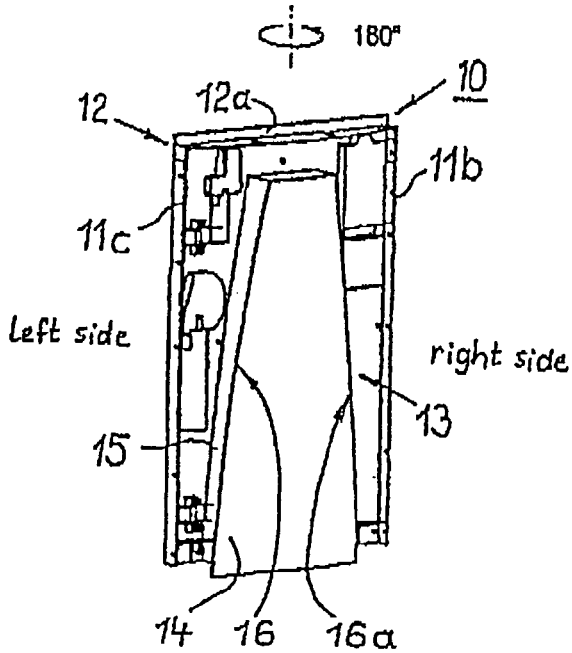

FIG. 8 a front elevational view onto an inner outer face of a door;

FIG. 8*a* a detail view of FIG. 8;

FIG. 9 a schematic view of the assembly of the outer door sheet and the inner door sheet.

Figure 3D:
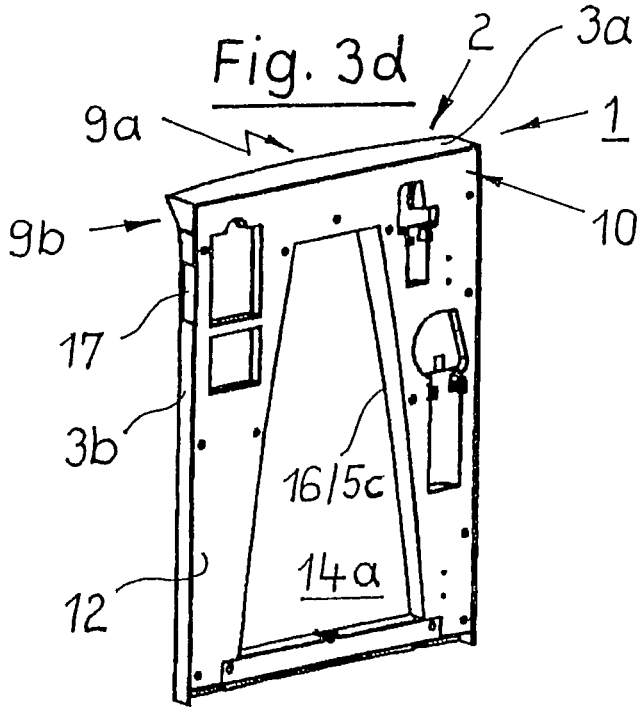

An embodiment of the novel door 1 composed out of two form parts is shown in FIG. 3 with a front elevational view onto the inner outer face 12 and is shown in FIG. 3*d* in a perspective view thereto. FIG. 3*a* shows a side elevational view of the door 1 and FIG. 3*b* shows a top planar view of the door 1. The two form parts, the outer door sheet 2 and the inner door sheet 10, exhibit various projections, angled parts, recesses, grooves or, respectively, slots and webs. These are disposed at the two parts 2, 10 in such correspondence to each other, that the preceding part regions of the two door sheets 2, 10 in an assembled state result in a support structure such that the body of the door 1 is in itself a very stable construction unit, in particular in the upper region, at the force engagement point during opening and closing of the door.

The outer door sheet 2 and the inner door sheet 10 are preferably produced out of plastic, such that the door becomes to be very light weight.

Preferably the inner door sheet 10, especially in its middle region, is made of a translucent material, and preferably out of a transparent material.

In the following the formation of the outer door sheet 2 of this embodiment is explained in more detail by way of FIGS. 1*a* and 1*b*. The outer door sheet 2 is a form body held essentially rectangular. The outer border starting from a body base face is angled by an angle of 90 degrees directed inwardly in the region of the left section 3*c*, of the upper section 3*a* and of the right section 3*b*. This border runs from the lower edge of the left section 3*c* over the upper section circulating up to down to the lower edge of the right section 3*b*. The recited directions left, right, and upper result from a view onto the front face of a paper shredder at which such a door is attached.

The lower section 3*d* of the outer border 3 exhibits no angle. This lower section 3*d* is symmetrical, furnished with a door arch shaped recess 5 from below, wherein the recess 5 preferably upwardly projects into the upper region of the outer door sheet 2. This door arch shaped recess 5 is formed in each case on the left and on the right by a longitudinal arm 5*a*, which is formed directed on the side upwardly and is delimited by an upper cross arm 5*b* in the vertical extension. The longitudinal arms 5*a* run according to this embodiment slightly curved. The front edge 5*c* of the longitudinal arms 5*a* has a U-shaped form, wherein the open side of the "U" points in each case in the direction of the outer border of the outer door sheet 2. A corresponding counter part of the inner door sheet 10 engages in this groove furnished in each longitudinal arm 5*a*, as will be described below.

An inner circulating border 6, which border 6 projects about rectangularly from the inner side 8 of the outer front face 4, runs at some distance to the longitudinal arms 5*a* and the upper cross arm 5*b* slightly recessed in body inward direction. Several webs 7 disposed essentially cross and/or inclined are furnished between the inner circulating border 6 and the outer circulating border 3 for further stiffening the door 1.

The inner door sheet 10 is shown in the FIGS. 2*a* and 2*b* in a front elevational view or, respectively in a perspective view. The base face of this inner door sheet 10 is an essentially rectangular thin plate with an outer face 12. This outer face 12 shows in its use position toward the inner chamber 20 of the paper shredder 18 and rests at the front faces 24 of the casing 19 of the paper shredder, view also FIG. 4 to this point.

The inner door sheet 10 also has a border 11 circulating in the upper, right and left section 11*a*, 11*b* and 11*c*, wherein the border 11 is aligned and directed inwardly to the body from the outer face 12 under an angle, preferably an angle of 90 degrees. The lower section 11*d* of the border 11 does not exhibit such angle. A web 12*a* projecting upwardly in the plane of the outer face 12 is furnished at the upper section 11*a* of the border 11; which web 12*a* rests at the upper section 3*a* of the border 3 of the outer door sheet 2 in the assembled state of the door. The upper sections 3*a*, 11*a*, the right sections 3*b*, 11*b*, and the left sections 3*c*, 11*c* form matchingly rest in each case against each other in the assembled state. These border sections are shape matchingly connected to each other at least in sections, by way of lockingly engaging, adhesive attachment or welding. A correspondingly running depression or niche 14 is furnished at the inner door sheet 10 symmetrically to the symmetry plane of the inner door sheet 10 corresponding to the door arch shaped recess 5 in the outer door sheet 2. This depression 14 forms a niche 14*a* in the body of the door 1 in the assembled state.

Frontal edges 16 are furnished at the depression 14 corresponding to the course of the longitudinal arms 5*a* of the door arch shaped recess 5. These edges 16 exhibit a hook shaped course of the edge corresponding to the U-shaped formed profile edges 5*c* of the outer door sheet 2. The outer door sheet 2 and the inner door sheet 10 are slid into each other by a relative motion to each other during assembly of the door, wherein the profiled edge 16 hooks into the profiled edge 5*c* and runs along this profiled edge 5*c* until the final position of the assembly has been reached. The depression 14 is formed such that a support face 15 circulating on three sides is formed for further increasing the stability. This support face 15 rests shape matchingly at the inner, circulating border 6 of the door arch shaped recess 5 in an assembled state of the door.

The completely assembled door 1 is shown in a front elevational view from the inside in FIG. 3 as initially mentioned. In addition, further recesses or, respectively, depressions are furnished in the outer face 12 of the inner door sheet 10, wherein accessories for the paper shredder, such as for example maintenance oil, catch bags and the like can be stored.

At least the front face of the depression 14, however preferably the complete inner door sheet 10 are produced out of an at least translucent material, preferably transparent material and in particular plastic, such that always a view can be cast into the inner chamber 20 and onto the comminuted material.

The finished assembled door is shown in FIG. 3*a* in a side elevational view from the right. FIG. 3*b* is a top planar view relative to the presentation in FIG. 3 along section line D-D. The position of the outer face 12 and of the front face 4 as well as the position of the niche 14*a* formed by the depression 14 can here been seen in the door 1.

The positioning of the border regions 3*a*, 11*a*, and 12*a* of the outer door sheet 2 and of the inner door sheet 10 relative to each other are shown in a sectional view in FIG. 3, the detail "B" according to FIG. 3*a*.

FIG. 3*g* shows the detail "F" out of the presentation according to FIG. 3*b*, the special profiled form of the edge 5*c* of the longitudinal arm 5*a* of the door arch shaped recess 5 as well as also the special profiled structuring of the front edge 16 of the inner door sheet 10. In this presentation in addition there can also be recognized the form matching resting of the inner circulating border 6 of the outer door sheet 2 and the support face 15 of the inner door sheet 10, which support face 15 is circulating on three sides.

Figure 3E:
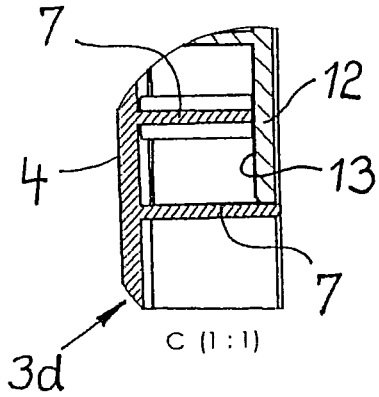
Figure 3F:
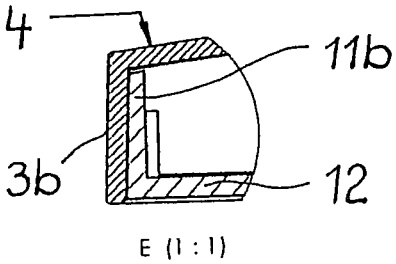

Further details of the shape matching resting of the profiled sections of the outer door plate 2 and the inner door plate 10 are shown in addition in the details "E" according to FIG. 3*b* and detail "C" according to FIG. 3*a* in the FIGS. 3*f* and 3*e*. The form closure of the side borders 3*b* of the outer door sheet with the right, angled section 11*b* of the inner door sheet 10, which forms an angle at the outer face 12 of the inner door sheet 10, can be seen in FIG. 3*f*.

The lower region of the door is shown in FIG. 3*e* in a sectional view and a detail view according to detail "C" of FIG. 3*a*. The lower section 3*d* of the outer door sheet 2 form the closure of the front face 4 of the outer door sheet 2, without presence of an angle. This presentation shows in addition the position of web 7 relative to the inner side 13 of the outer face 12 of the inner door sheet 10.

Screw connections are provided at locations (without reference characters) marked in FIG. 3 and, respectively, in FIG. 3*d* with points on the outer face 12 in order to achieve in addition to a shape matching connection also a force matching connection, which increases the stiffness of the door and which is however disengageable.

A higher stiffness of the assembled door can also be obtained by having the form matching faces resting against each other of the outer door sheet 2 and of the inner door sheet 10 adhesively attached or welded together at points or over larger face sections.

A paper shredder is schematically shown in FIG. 4 where the precedingly described new door is applied. A paper shredder 18 with a casing 19 has an inner chamber 20, wherein a catch bag 21 is disposed at a support 22 supported in guides 23 in the inner chamber 20 for receiving comminuted material. According to the invention a door 1 is attached with hinges 25 at the casing 19 and is shown here in an opened position. In a closed position, the door 1 with its outer face 12 of the inner door sheet 10 and the outer border 3 of the outer door sheet 2 will rest at one or several front faces of the casing 19 and will close the inner chamber 20, such that the paper shredder can operate without endangering the operator.

A safety switch which of course is present and which upon opening of the door 1, that is upon releasing of the inner chamber 20 with an access to the cutting works 27, will stop the drive of the paper shredder and is not illustrated. The material and paper feed has the reference character 26.

The invention is not restricted to the embodiment shown, but is variable in a multitude of way within the framework of the invention. In particular, no limits are set to the selection of the material for the production of the outer door sheet 2 as well as of the inner door sheet 10 as well as in the forming of contours and design. The selection of a suitable material will be oriented to the objects present for a certain paper shredder or, respectively, at the development of new materials in the corresponding specialized field.

Therefore it is shown in FIG. 3*b* with the reference characters 9*a* and 9*b* that for example in the upper region of the outer door sheet 2 the edge region of the outer upper border 3*a* has a horizontally directed convex arching 9*a* as well as a body downward directed concave arching. It is thereby accomplished that the distance between door and operator is relative to the upper door region larger in the foot region such that the operator can step closer to the feed slot o, respectively, the material placement, without that the operator would damage the lower door region with his feet or bends to the paper receptacle, wherewith a tie, chain or for example a scarf approach the material insertion slot in an endangering way.

LIST OF REFERENCE NUMERALS

1 door
2 outer door sheet
3 outer border of position 2
3*a* upper section
3*b* right section
3*c* left section
3*d* lower section
4 front face of position 2
5 door arch shaped recess of position 2
5*a* longitudinal arm (extending upwardly laterally)
5*b* upper cross arm
5*c* edge (at position 5*a*)
6 inner circulating border (at position 5)
7 webs
8 inner side of position 4
9*a* horizontal, convex arching of position 4
9*b* concave, vertical arching of position 4
10 inner door sheet
11 border
11*a* upper section
11*b* right section
11*c* left section
11*d* lower section
12 outer face
12*a* web
13 inner side
14 depression
14*a* niche
15 support face circulating on three sides
16 front edge at position 14
17 recessed grip, handle butt (on two sides)
18 paper shredder
19 casing
20 inner chamber

21 catch bag
22 support
23 guides
24 front face
25 hinges
26 paper charger

The invention claimed is:

1. A door in combination with a paper shredder comprising:

an opening of a housing of the paper shredder;

the door opening and closing said opening, wherein said door is disposed below a cutting works in the housing and includes at least one view window as well as hinges attached to the housing for rotating the door between open and closed positions;

the door is composed of an outer door sheet with a front face and an inner door sheet with an outer face;

the outer door sheet comprises a U-shaped opening and an outer perimeter including three outer perimeter sections, wherein each outer perimeter section extends substantially at a 90 degree angle with respect to the front face and the U-shaped opening has an inner perimeter with one end thereof open;

the inner door sheet comprises an outer border including three outer border sections and a protrusion with a support face on said protrusion, wherein each outer border section and the support face extend substantially at a 90 degree angle with respect to the outer face;

at least two of the outer perimeter sections are supported and in contact with at least two of the outer border sections;

the inner perimeter of the U-shaped opening is supported and in contact with the support face of the protrusion for further stiffening the door; and the inner door sheet is constructed of a translucent plastic.

2. The door in combination with the paper shredder according to claim 1, wherein the outer door sheet and the inner door sheet are connected by screws, adhesive, or welding.

* * * * *